US008151528B2

(12) United States Patent
Masters et al.

(10) Patent No.: US 8,151,528 B2
(45) Date of Patent: Apr. 10, 2012

(54) SYSTEM AND METHOD FOR ANCHORING A MODULAR BUILDING

(75) Inventors: William C. Masters, Lakeland, FL (US); William J. Kalker, Jr., Monroe, CT (US)

(73) Assignee: Building Technologies Incorporated, Lakeland, FL (US)

( * ) Notice: Subject to any disclaimer, the term of this patent is extended or adjusted under 35 U.S.C. 154(b) by 218 days.

(21) Appl. No.: 12/472,753

(22) Filed: May 27, 2009

(65) Prior Publication Data

US 2009/0293393 A1 Dec. 3, 2009

Related U.S. Application Data

(60) Provisional application No. 61/056,591, filed on May 28, 2008.

(51) Int. Cl.

| | |
|---|---|
| ***E04H 6/00*** | (2006.01) |
| ***E04B 1/00*** | (2006.01) |
| ***E02D 5/74*** | (2006.01) |
| ***E02D 27/32*** | (2006.01) |
| ***E04G 21/00*** | (2006.01) |

(52) U.S. Cl. ..... 52/295; 52/79.13; 52/155; 52/169.9; 52/741.15

(58) Field of Classification Search ..... 52/294, 52/295, 296, 297, 299, 79.9, 79.11, 79.13, 52/741.11, 741.13, 741.14, 741.15, 292, 52/293.1, 293.2, 293.3, 169.9, 155, 156, 52/157, 162, 164, 165

See application file for complete search history.

(56) References Cited

U.S. PATENT DOCUMENTS

| | | | | |
|---|---|---|---|---|
| 887,217 | A * | 5/1908 | Oliphant | 52/295 |
| 4,627,205 | A * | 12/1986 | Hitchins | 52/294 |
| 4,716,696 | A * | 1/1988 | Yacoboni | 52/169.9 |
| 4,923,165 | A * | 5/1990 | Cockman | 248/545 |
| 5,402,614 | A * | 4/1995 | Jewell | 52/299 |
| 5,467,569 | A * | 11/1995 | Chiodo | 52/713 |
| 6,094,873 | A * | 8/2000 | Hoffman et al. | 52/126.6 |
| 6,352,390 | B1 * | 3/2002 | Jones | 405/230 |
| 6,460,297 | B1 | 10/2002 | Bonds et al. | |
| 6,526,721 | B1 * | 3/2003 | Nash | 52/677 |
| 6,807,782 | B2 * | 10/2004 | Forman et al. | 52/293.1 |
| 6,931,803 | B1 | 8/2005 | Davis et al. | |
| 7,165,915 | B2 * | 1/2007 | Queen | 405/244 |
| 7,171,788 | B2 | 2/2007 | Bronner | |
| 7,243,464 | B1 | 7/2007 | Crowell | |
| 7,412,805 | B2 | 8/2008 | Parrish | |
| 7,444,782 | B2 | 11/2008 | Crowell | |
| 7,454,872 | B2 * | 11/2008 | Cutforth | 52/295 |
| 2004/0091322 | A1 * | 5/2004 | May | 405/244 |
| 2006/0201087 | A1 * | 9/2006 | Cutforth | 52/296 |
| 2006/0265982 | A1 * | 11/2006 | Greenberg et al. | 52/293.1 |
| 2007/0107339 | A1 * | 5/2007 | Matsumoto | 52/295 |

* cited by examiner

*Primary Examiner* — Jessica Laux
*Assistant Examiner* — Ryan Kwiecinski
(74) *Attorney, Agent, or Firm* — Robert L. Wolter, Esq.; Beusse Wolter Sanks Mora & Maire, P.A.

(57) ABSTRACT

The present invention provides a system for anchoring a modular or manufactured building. The system includes at least one concrete pad formed in at least one hole in the ground. The building is coupled to and supported on the ground by the at least one concrete pad. Additionally, the system includes at least one ground anchor buried in the at least one hole below the at least one concrete pad. The system further includes a connector having a first end affixed to the ground anchor and a second end embedded within the concrete pad, for resisting an upward force to the building by high winds.

18 Claims, 5 Drawing Sheets

SYSTEM AND METHOD FOR ANCHORING A MODULAR BUILDING

CROSS-REFERENCE TO RELATED APPLICATIONS

This application claims the benefit of U.S. Provisional Application No. 61/056,591 filed May 28, 2008, and incorporated herein by reference in its entirety.

BACKGROUND OF THE INVENTION

This invention relates generally to the construction of manufactured or modular buildings. More specifically, the present invention relates to systems and methods used to anchor a building against vertical upward loads caused by high winds.

State and Federal laws, regulations and codes require that manufactured or modular buildings bear predetermined horizontal or vertical loads caused by high winds. A manufactured or modular building may be supported on an array of masonry block columns and concrete pads. Concrete pads are formed in the ground according to a predetermined arrangement to support a building. One or more masonry block columns are coupled to the respective pads by rebar rods extending through the blocks and into the concrete pads. A cement fill is poured in the masonry blocks to support the column on the concrete pads.

Connectors (not shown) known to those skilled in the art secure the building frame to the masonry columns. In addition, tie down connectors are installed to counteract uplift and sliding forces caused by high winds. The tie down connectors typically include a ground anchor having a shaft buried in the ground with a head exposed above the ground. The ground anchors are positioned at locations in the ground not occupied by the concrete pads. Straps affixed to the building frame, or I-beams supporting the building, are coupled to the heads of the ground anchors tying the building to the ground anchor to counteract the forces created by high winds.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention, and are not therefore to be considered to be limiting of its scope; the invention will be described and explained with additional specificity and detail through the use of the accompanying drawings.

BRIEF DESCRIPTION OF THE INVENTION

Figure 1:
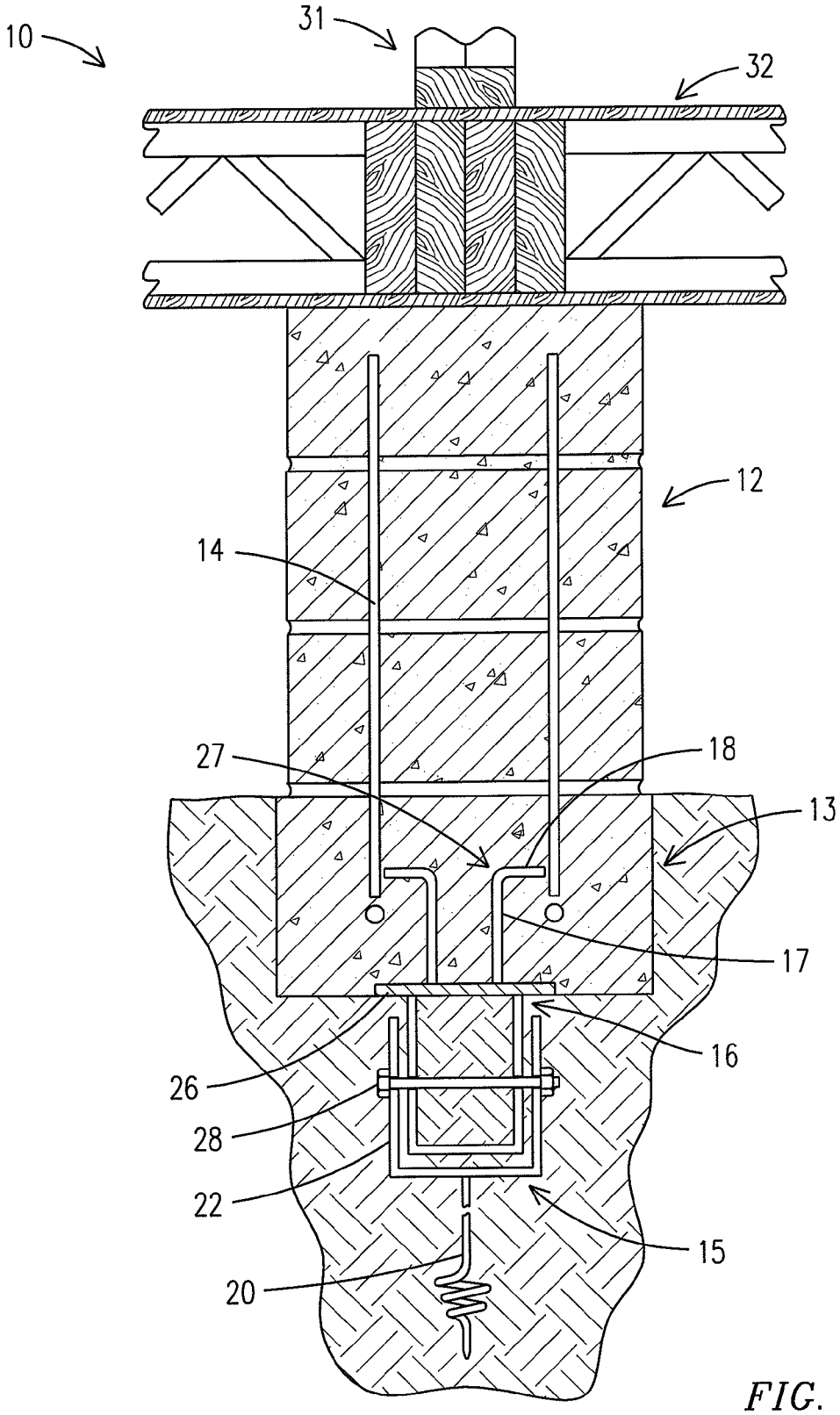
FIG. 1 is a sectional view of the present invention for a system for anchoring a modular building.

One embodiment of the present invention provides a system for anchoring a modular or manufactured building. The system includes at least one concrete pad formed in at least one hole in the ground. The building is coupled to and supported on the ground by the at least one concrete pad. Additionally, the system includes at least one ground anchor buried in the at least one hole below the at least one concrete pad. The system further includes a connector having a first end affixed to the ground anchor and a second end embedded within the concrete pad, for resisting an upward force to the building by high winds.

Another embodiment of the present invention provides a system for anchoring a modular or manufactured building. The system includes at least one concrete pad formed in at least one hole in the ground. The building is coupled to and supported on the ground by the at least one concrete pad. Additionally, the system includes at least one ground anchor buried in the at least one hole below the at least one concrete pad, where the ground anchor includes an anchor head having a pair of spaced apart plates. The system further includes a connector to couple the at least one concrete pad to the at least one ground anchor, to resist an upward force to the building by high winds. The connector includes a body portion having a pair of spaced apart side plates. The flanges and the side plates are respectively spaced apart such that the anchor head is received within the body portion of the connector.

Another embodiment of the present invention provides a method for anchoring a modular or manufactured building. The method includes excavating a plurality of holes for forming a respective plurality of concrete pads to support a building. Additionally, the method includes burying a plurality of ground anchors in the respective plurality of holes with a head of the ground anchors below grade level. The method further includes affixing a first end of a connector to the head of the ground anchor, where the connector has a portion disposed above grade level. The method further includes forming a concrete pad in the hole with a second end of the connector being embedded within the concrete pad.

DETAILED DESCRIPTION OF THE INVENTION

Reference will now be made in detail to the embodiments consistent with the invention, examples of which are illustrated in the accompanying drawings. Wherever possible, the same reference numerals are used throughout the drawings and refer to the same or like parts.

With respect to FIG. 1 there is shown a system for anchoring a modular or manufactured building. The building 10 includes a frame comprising a plurality of vertically disposed wall frames 31 mounted to a floor system 32 A plurality of concrete pads 13 are formed in a respective hole in the ground underneath the building 10 according to a predetermined arrangement, and a plurality of masonry block columns 12 are coupled to each concrete pad 13 to support the building 10 above the ground. The building 10 is coupled to and supported on the ground by the concrete pads 13. A cement fill is poured in the masonry columns 12, and a vertically disposed rebar 14, that extends through the masonry columns and into concrete pads 13, couples the columns 12 to the concrete pads 13. Although FIG. 1 illustrates a single concrete pad 13 formed in a hole in the ground underneath the building 10, a plurality of concrete pads 13 are formed in respective holes in the ground underneath the building 10, as discussed above.

A ground anchor 15 is buried in the ground below the concrete pad 13. The ground anchor 15 includes a shaft 20 and an anchor head 22, both of which are buried in the ground below the concrete pad 13, and below grade level. A connector 16 includes a first end which is affixed to the anchor head 22 of ground anchor 15 and includes a second end having one or more hooks 27 coupled to the anchor head 22, which extend upward into the pad 13 (above grade level) for resisting an upward force to the building 10 by high winds. The hooks 27 include a first section 17 that is coupled to the anchor head 22 that extends upward therefrom and a second (or lateral) section 18 that is disposed laterally with respect to the first section 17. In an exemplary embodiment, the first section 17 of the hook 27 extends upward within the concrete pad 13, and the second section 18 may be disposed laterally within the concrete pad 13.

Figure 2:
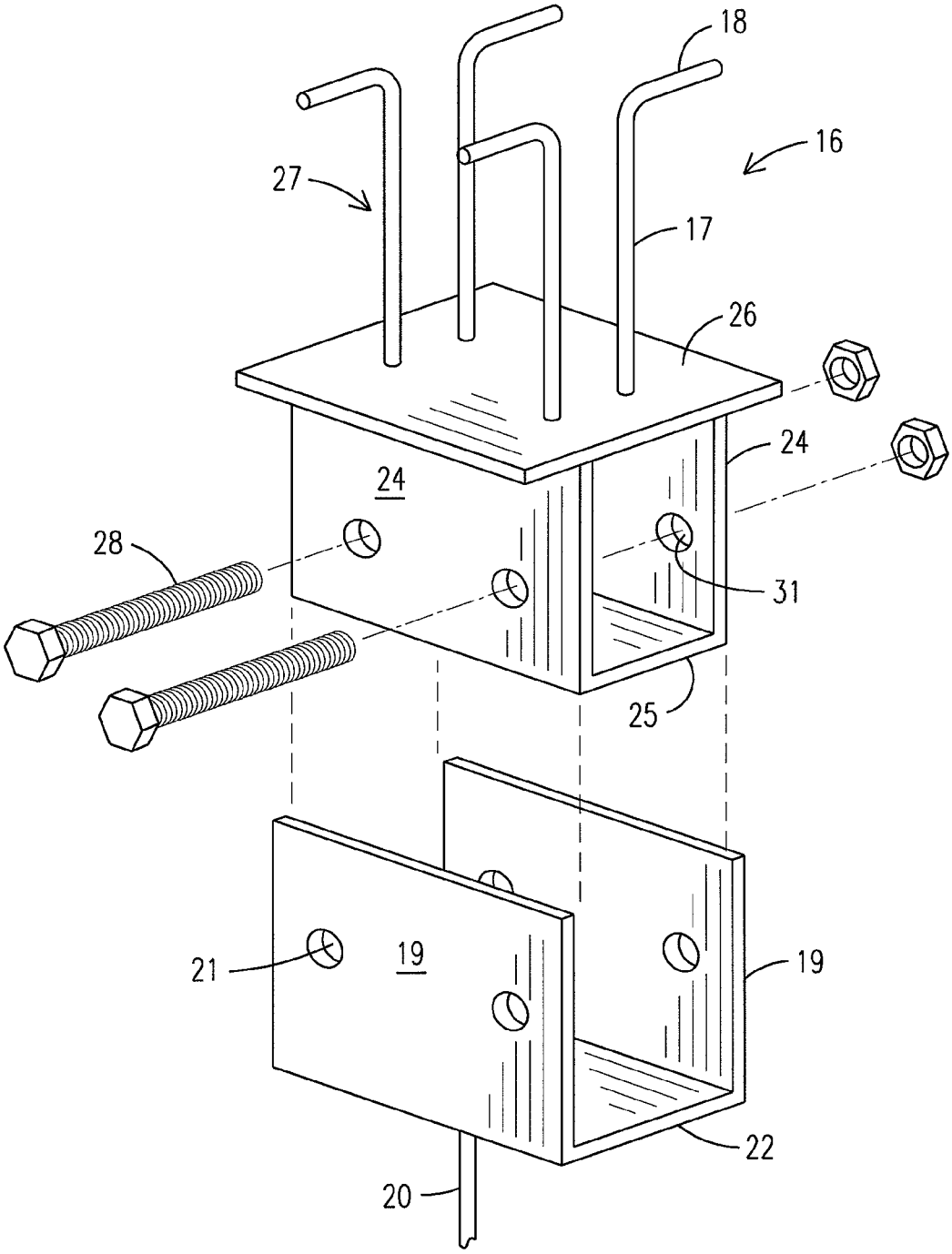
FIG. 2 is a perspective view of a ground anchor and connector for the present invention.
Figure 3:
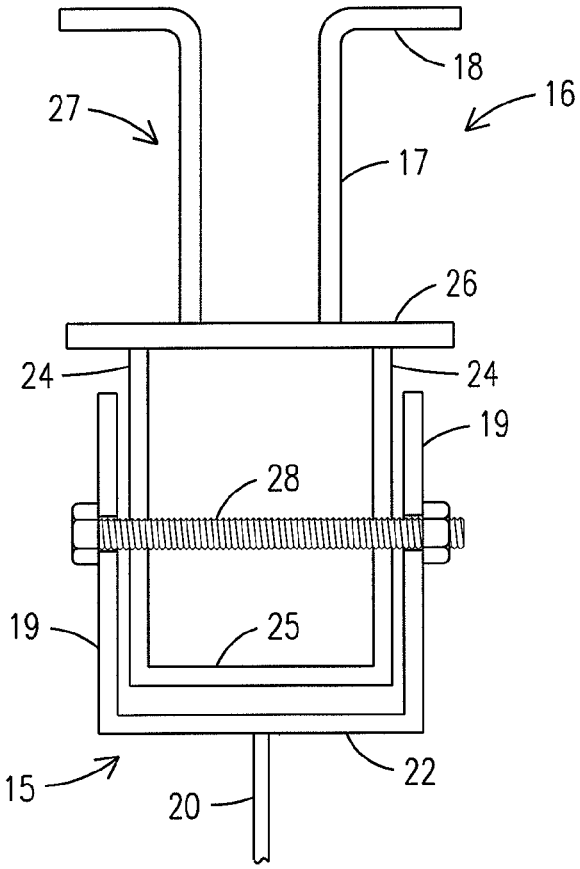
FIG. 3 is a front elevational view of the connector bolted to the ground anchor.

In a first embodiment shown in FIGS. 2 and 3, the anchor head 22 is a generally U-shaped member having flanges 19 spaced apart for receiving the connector 16, which includes the hooks 27. The first end of the connector 16 may comprise a body portion that includes the spaced apart side plates 24 having holes 31 that are aligned with the apertures 21 on flanges 19 of the anchor head 22. The body portion also includes a first or bottom plate 25 and a second or top plate 26 affixed to respective ends of the plates 24 forming a box-like tube member. The hooks 27 of the second end of the connector 16 are affixed to the top plate 26, and extend upward from the top plate 26 to within the concrete pad 13. The side plates 24 of the body portion and the flanges 19 of the anchor head 22 may be respectively spaced apart such that the anchor head 22 can receive the body portion of the connector 16. Additionally, the apertures 21 on the flanges 19 and the holes 31 of the side plates 24 may be similarly spaced apart and dimensioned, such that a bolt and nut assembly 28 secures the connector 16 to the anchor head 22, by passing the bolt and nut assembly 28 through the aligned apertures 21 on the flanges 19 and the holes 31 of the side plates 24. In an exemplary embodiment, the top plate 26 may be a ¼" to ½" thick steel plate welded to the side plates 24, and the hooks 27 may be about ⅝" to about ¾" in diameter.

Depending on the type of the ground anchor 15 utilized or the load values to be achieved, the components of the connector 16 and their dimensions may vary. For example, some flanges 19 of the anchor head 22 may each have two apertures 21. Accordingly, the body of the connector 16 may have the same number of holes 31 aligned with the apertures 21, and more than one bolt and nut assemblies 28. In addition, the connector 16 may have more or fewer (as few as one hook) hooks 27 than the four hooks 27 shown in FIG. 2. In reference to the bolt assembly 28, other fastener means for attaching the hooks 27 of the connector 16 to the anchor head 22 of the ground anchor 15, may be used and depend in part on the type of ground anchor 15 or anchor head 22 used. For example, clamping systems may be used to affix hooks 27 directly to a flange 19 of the anchor head 22; and, in some cases a single flange 19 may make up the anchor head 22.

Figure 4:
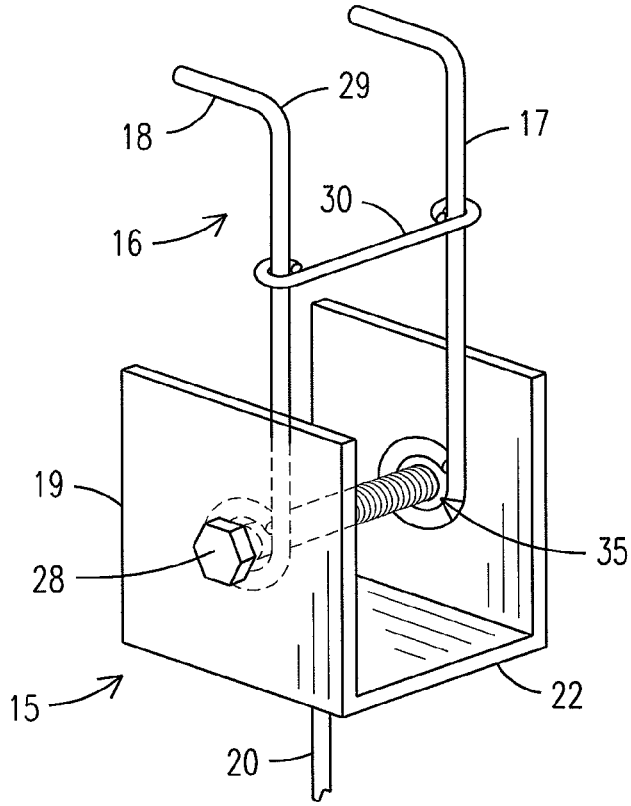
FIG. 4 is a perspective view of a second embodiment of the invention.
Figure 5:
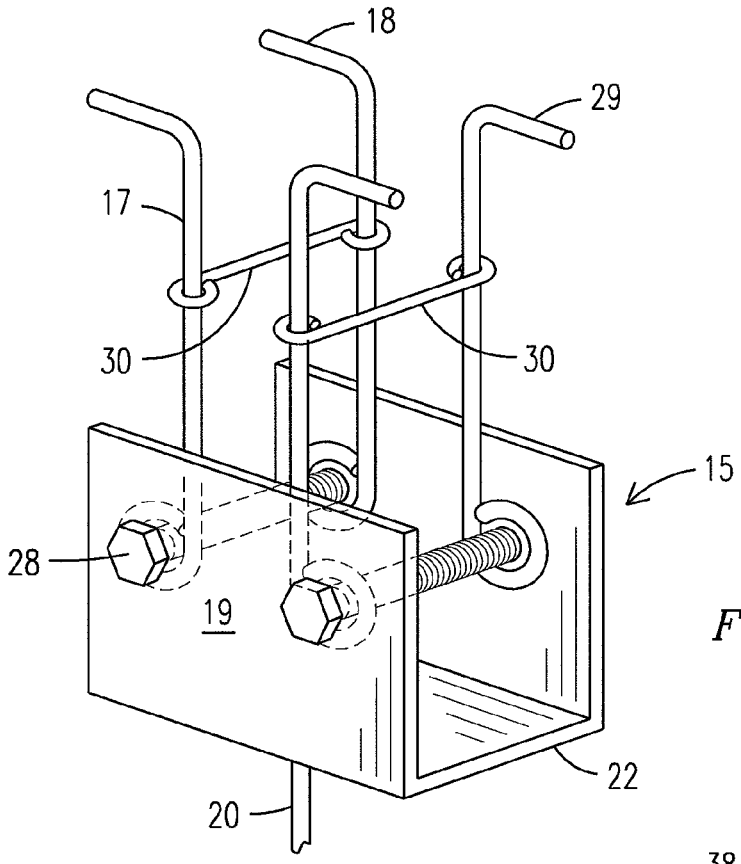
FIG. 5 is a perspective view of a third embodiment of the invention.

With respect to FIGS. 4 and 5, there is illustrated a second embodiment of the invention, in which the connector includes a plurality of hooks 29 having eyes 35 aligned with the apertures 21 on the anchor head 22. A spacer 30 is disposed between the hooks 29, to support the hooks 29 in a fixed spaced relationship relative to one another when the hooks 29 are embedded in the concrete pads 13 as described below. As shown in FIG. 5, the second embodiment may include more than the two hooks 29 shown in FIG. 4. As illustrated in the exemplary embodiment of FIG. 4, a nut and bolt assembly 28 is passed through the aperture 21 of the anchor head 22 and the eyes 35 of the hooks 29, to secure the first section 17 of the hook 29 to the anchor head 22. The eyes 35 of the hooks 29 are spaced and dimensioned to be aligned with the apertures 21 of the anchor head 22, along an inner surface of the anchor head 22. As illustrated in the exemplary embodiment of FIG. 5, two pairs of hooks 29 are secured to the anchor head 22, with a respective spacer 30 positioned between the first sections 17 of each pair of hooks 29. The pairs of hooks 29 include a respective pair of eyes 35, which are similarly spaced and dimensioned to be aligned with the apertures 21 of the anchor head 22, along the opposing inner surfaces of the anchor head 22. In the exemplary embodiment of FIGS. 4 and 5, the second section 17 of the hooks 29 may be oriented in a lateral direction, relative to the first section 18, and in opposing directions, among respective pairs of hooks 29. As with the embodiment of the present invention discussed above, more than two pairs of hooks may be secured to the anchor head 22.

Figure 6:
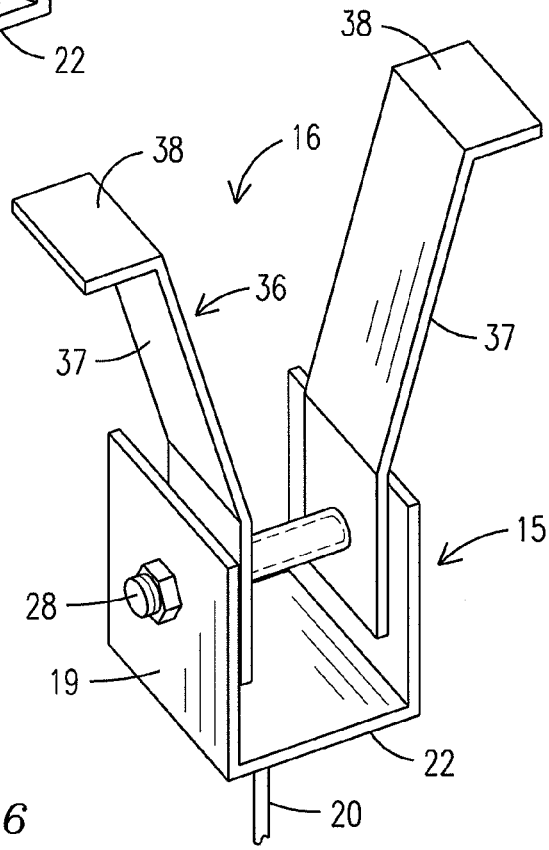
FIG. 6 is a perspective view of a fourth embodiment of the invention.

With respect to FIG. 6 there is shown a third embodiment having hooks 36 mounted directly to the anchor head 22. The hooks 36 include a first upwardly extending section 37 that is disposed at an angle relative to one of the flanges 19. The first sections 37 include a respective aperture which is spaced and dimensioned to be aligned with the respective aperture of the flanges 19, along an inner surface of the anchor head 22. The bolt and nut assembly 28 is passed through the aperture of the first section 37 and the aperture of the flange 19, to secure the first section 37 to the inner surface of the anchor head 22. As illustrated in the exemplary embodiment of FIG. 6, the first section 37 extends upward within the concrete pad 13, in an outward direction relative to the inner surface of the anchor head 22. In an exemplary embodiment, once the first sections 37 of the hooks 36 are secured to the inner surface of the anchor head 22, an angle between an outer surface of the flange 19 and an outer surface of the first section 37 is less than 180 degrees, while an angle between an inner surface of the flange 19 and an inner surface of the first section 37 is greater than 180 degrees. However, the embodiments of the present invention are not limited to these angular conditions, as the first section 37 may extend in an inwardly direction or in a direction perpendicular to the face of the flange 19, for example. Additionally, once the first sections 37 of the hooks 36 are secured to the anchor head 22, the second sections 38 of the hooks 36 point in an outward direction, based on an outer surface of the anchor head 22, and the second sections 38 point in opposing directions. Although FIG. 6 illustrates a pair of hooks 36 being secured to the anchor head 22, more than one pair of hooks may be secured to the anchor head, based on the individual predetermined load requirements of the building, for example.

Figure 7:
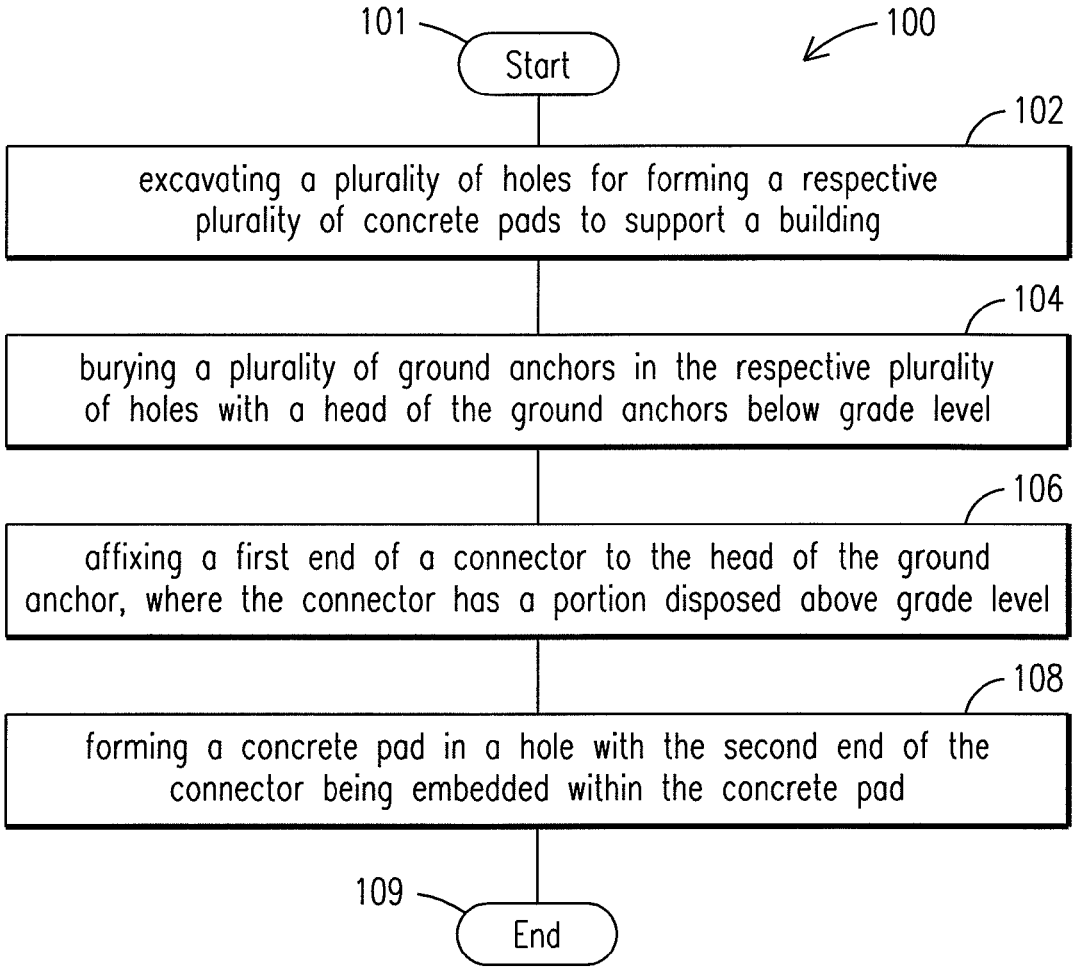
FIG. 7 is a flowchart depicting a method for anchoring a modular building.

FIG. 7 illustrates an exemplary embodiment of a method 100 for anchoring a modular or manufactured building. The method 100 begins at 101 by excavating 102 a plurality of holes for forming the respective plurality of concrete pads 13 to support the building 10. The method 100 further includes burying 104 the plurality of ground anchors 15 in the respective plurality of holes with the head 22 of the ground anchors below grade level. The method 100 further includes affixing 106 the first end of the connector 16 to the head 22 of the ground anchor 15, where the connector 16 has a portion disposed above grade level. The method 100 further includes forming 108 the concrete pad 13 in the hole with the second end of the connector 16 being embedded within the concrete pad 13, before ending at 109.

While the preferred embodiments of the present invention have been shown and described herein, it will be obvious that such embodiments are provided by way of example only and not of limitation. Numerous variations, changes and substitutions will occur to those skilled in the art without departing from the teaching of the present invention. Accordingly, it is intended that the invention be interpreted within the full spirit and scope of the appended claims.

What is claimed is:

1. A system for anchoring a modular or manufactured building, comprising:

at least one concrete pad formed in at least one hole in the ground wherein the building is coupled to and supported on the ground by the at least one concrete pad;

at least one ground anchor buried below grade level of a bottom of the at least one hole and below the at least one concrete pad; and, a connector having a first end affixed to the ground anchor below grade level of the bottom of the at least one hole and a second end embedded within the concrete pad above grade level of the bottom of the at least one hole for resisting an upward force to the building by high winds, wherein the ground anchor comprises an anchor head, said anchor head including a plurality of spaced apart flanges; wherein the first end of the connector comprises a body portion, said body portion including a plurality of spaced apart side plates; and wherein the flanges and the side plates are respectively spaced apart such that the anchor head is configured to receive the body portion of the connector.

2. The system of claim 1, further comprising a support column coupled to and on top of the concrete pad and having at least one masonry block filled with concrete and at least one rebar rod extending through the block and into the concrete pad.

3. The system of claim 2, wherein the second end of the connector comprises at least one hook, wherein said at least one hook is configured to extend upward within the concrete pad, such that the second end of the connector is secured to the concrete pad.

4. The system of claim 1, wherein upon said body portion of the connector being received within the anchor head, at least one fastener is configured to secure the body portion of the connector and the anchor head, such that the first end of the connector is secured to the ground anchor.

5. The system of claim 1, wherein the plurality of spaced apart flanges and the plurality of spaced apart side plates respectively include at least one aperture; wherein upon said body portion of the connector being received within the anchor head, said respective at least one aperture in the flanges and in the side plates are aligned; and wherein at least one bolt is configured to be passed through the respective at least one aperture in the flanges and in the side plates, to secure the first end of the connector to the ground anchor.

6. A system for anchoring a modular or manufactured building, comprising:

at least one concrete pad formed in at least one hole in the ground wherein the building is coupled to and supported on the ground by the at least one concrete pad;

at least one ground anchor buried below grade level of a bottom of the at least one hole and below the at least one concrete pad; and, a connector having a first end affixed to the ground anchor below grade level of the bottom of the at least one hole and a second end embedded within the concrete pad above grade level of the bottom of the at least one hole for resisting an upward force to the building by high winds, wherein the ground anchor comprises an anchor head, and wherein the connector includes at least one hook having a first section coupled to said anchor head and configured to extend upward to within the concrete pad, and a second section disposed laterally relative to the first section.

7. The system of claim 6, wherein said anchor head includes a plurality of spaced apart flanges; wherein the first end of the connector comprises a body portion, said body portion including a plurality of spaced apart side plates, a top plate and a bottom plate; wherein the flanges and the side plates are respectively spaced apart such that the anchor head is configured to receive the body portion of the connector; and wherein the first section of said at least one hook is secured to said top plate and is configured to extend upward from said top plate to within the concrete pad.

8. The system of claim 6, wherein said anchor head includes a plurality of spaced apart flanges, said flanges having at least one respective aperture; wherein said first section of said at least one hook includes a circular eye portion configured to be aligned with said at least one respective aperture along an inner surface of said anchor head; and wherein a bolt is configured to be passed through said at least one aperture and said at least one circular eye portion, to secure said first section of said at least one hook to said anchor head.

9. The system of claim 8, wherein the second end of the connector comprises at least one pair of hooks; wherein said first sections of said at least one pair of hooks include a respective pair of circular eye portions, said respective pair of circular eye portions are configured to be aligned with said at least one respective aperture along the inner surface of said anchor head; and wherein a spacer is disposed between the first sections of each pair of hooks, to support each pair of hooks in a fixed relative spatial relationship.

10. The system of claim 6, wherein the second end of the connector comprises at least one pair of hooks; wherein said anchor head includes a plurality of spaced apart flanges, said flanges having at least one respective aperture; wherein said first section of said at least one pair of hooks include at least one respective aperture configured to be aligned with said at least one aperture of said flanges along an inner surface of said anchor head; and wherein a bolt is configured to be passed through said at least one aperture of said flanges and said at least one aperture of said first section, to secure said first section of said at least one pair of hooks to said anchor head, and wherein said first section of said at least one pair of hooks is configured to extend upward within the concrete pad in an outward direction relative to said inner surface of said anchor head.

11. The system of claim 10, wherein upon said at least one pair of hooks being secured within the concrete pad, an angle between an outer surface of the flanges and an outer surface of the first section of said at least one pair of hooks is less than 180 degrees; and wherein upon said at least one pair of hooks being secured within the concrete pad, an angle between an inner surface of the flanges and an inner surface of the first section of said at least one pair of hooks is greater than 180 degrees.

12. The system of claim 10, wherein upon said at least one pair of hooks being secured within the concrete pad, the second section of each hook of said pair of hooks is configured to point in an outer direction based on an outer surface of each respective flange to which the respective hook is secured; and wherein said second sections of said pair of hooks are configured to point in opposing directions.

13. A system for anchoring a modular or manufactured building, comprising:

at least one concrete pad formed in at least one hole in the ground wherein the building is coupled to and supported on the ground by the at least one concrete pad;

at least one ground anchor buried below grade level of a bottom of the at least one hole below the at least one concrete pad, said ground anchor including an anchor head having a pair of spaced apart flanges; and a connector configured to couple the at least one concrete pad to the at least one ground anchor above grade level of the bottom of the at least one hole to resist an upward force to the building by high winds, said connector including a body portion having a pair of spaced apart side plates;

wherein the flanges and the side plates are respectively spaced apart such that the anchor head is configured to be received within the body portion of the connector below the grade level of the bottom of the at least one hole.

14. A method for anchoring a modular or manufactured building, comprising:

excavating a plurality of holes for forming a respective plurality of concrete pads to support a building;

burying a plurality of ground anchors in the respective plurality of holes with a head of the ground anchors below grade level of a bottom of the respective plurality of holes;

affixing a first end of a connector to the head of the ground anchor below grade level of the bottom of the respective plurality of holes and the connector having a second end disposed above grade level of the bottom of the respective plurality of holes; and, forming a concrete pad in the hole with the second end of the connector being embedded within the concrete pad, wherein the ground anchor comprises an anchor head, said anchor head includes a plurality of spaced apart flanges; wherein the first end of the connector comprises a body portion, said body portion including a plurality of spaced apart side plates; and wherein the method further comprises:

spacing apart the flanges and the side plates such that the anchor head is received within the body portion of the connector; and securing the body portion of the connector and the anchor head, such that the first end of the connector is secured to the ground anchor.

15. The method of claim 14, further comprising:

forming a respective support column on top of the concrete pads in which the connector is embedded;

coupling the support column to the concrete pad for anchoring the building thereto;

filling at least one masonry block of the support column with concrete; and extending at least one rebar through the masonry block and into the concrete pad.

16. The method of claim 15, wherein the second end of the connector comprises at least one hook, said method further comprising extending said at least one hook upward within the concrete pad, such that the second end of the connector is secured to the concrete pad.

17. The method of claim 16, wherein the ground anchor comprises an anchor head, and wherein said extending said at least one hook comprises:

extending a first section of said at least one hook upward to within the concrete pad; and extending a second section of said at least one hook in a lateral direction relative to the first section.

18. The method of claim 14, further comprising:

forming at least one aperture in the plurality of spaced apart flanges and the plurality of spaced apart side plates;

aligning said respective at least one aperture in the flanges and in the side plates; and passing at least one bolt through the respective at least one aperture in the flanges and in the side plates, to secure the first end of the connector to the ground anchor.

* * * * *